US005913779A

United States Patent [19]

Edvardsen

[11] Patent Number: 5,913,779

[45] Date of Patent: Jun. 22, 1999

[54] SHEET METAL FLASHING MEMBER FOR FRAME STRUCTURES OF ROOF WINDOWS OR SIMILAR ROOF PENETRATING BUILDING STRUCTURES AND A FLASHING FRAME COMPRISING SUCH A MEMBER

[75] Inventor: Allan Edvardsen, Skanderborg, Denmark

[73] Assignee: V. Kann Rasmussen Industri A/S, Soborg, Denmark

[21] Appl. No.: 09/051,125

[22] PCT Filed: Sep. 18, 1996

[86] PCT No.: PCT/DK96/00395

§ 371 Date: Apr. 1, 1998

§ 102(e) Date: Apr. 1, 1998

[87] PCT Pub. No.: WO97/13044

PCT Pub. Date: Apr. 10, 1997

[30] Foreign Application Priority Data

Oct. 4, 1995 [DK] Denmark ..... 1107/95

[51] Int. Cl.[6] ..... E04D 13/02; E04D 13/14

[52] U.S. Cl. ..... 52/58; 52/60

[58] Field of Search ..... 52/58, 60, 61, 52/200, 219, 748.1

[56] References Cited

U.S. PATENT DOCUMENTS

| | | | |
|---|---|---|---|
| 1,721,715 | 7/1929 | Schindler | 52/58 X |
| 1,875,640 | 9/1932 | Moore | 52/58 X |
| 3,247,632 | 4/1966 | Bloxsom . | |
| 3,838,544 | 10/1974 | Hindall | 52/219 X |
| 4,428,166 | 1/1984 | Burghart | 52/200 X |
| 4,543,753 | 10/1985 | Sonneborn et al. | 52/200 X |
| 4,603,517 | 8/1986 | Lyons, Jr. . | |
| 4,635,409 | 1/1987 | Vandemore . | |
| 4,700,512 | 10/1987 | Laska . | |
| 4,781,008 | 11/1988 | Lyons, Jr. | 52/58 X |
| 5,018,333 | 5/1991 | Bruhm | 52/200 X |
| 5,077,943 | 1/1992 | McGady . | |
| 5,706,610 | 1/1998 | Mayle | 52/58 X |

FOREIGN PATENT DOCUMENTS

| | | | |
|---|---|---|---|
| 98982 | 8/1964 | Denmark . | |
| 143297 | 10/1980 | Denmark . | |
| 36 03 303 | 8/1987 | Germany . | |
| 833539 | 4/1960 | United Kingdom | 52/58 |
| 1202864 | 8/1970 | United Kingdom | 52/58 |
| 1587199 | 4/1981 | United Kingdom | 52/219 |

*Primary Examiner*—Carl D. Friedman
*Assistant Examiner*—Laura A. Callo
*Attorney, Agent, or Firm*—Lane, Aitken & McCann

[57] ABSTRACT

A flashing member for frame structures of roof windows with main frame site surfaces substantially perpendicular to the surrounding parts of the roof surface comprises a shaped corner piece made in one piece from folded sheet material and with a first pair of wall sections for covering end parts of main frame side members penpendicular to one another, and a second pair of wall sections for covering the parts of the roof surface which border on said main frame side member, and a corner section for filling out between said second pair of wall sections. The first and the second pair of wall sections and the corner section are formed by folding from the same sheet billet, the parts of the sheet material not being part of the wall sections and the corner section being folded for providing partly two double-walled plane foldings which are parallel with the roof surface but perpendicular to each other, between the corner section and each of the second pair of wall sections, partly a double-walled triangular folding between the corner section and each of the first pair of wall sections.

4 Claims, 2 Drawing Sheets

SHEET METAL FLASHING MEMBER FOR FRAME STRUCTURES OF ROOF WINDOWS OR SIMILAR ROOF PENETRATING BUILDING STRUCTURES AND A FLASHING FRAME COMPRISING SUCH A MEMBER

The present invention relates to a sheet metal flashing member for frame structures of roof windows or similar roof penetrating building structures with main frame side surfaces substantially perpendicular to the surrounding parts of the roof surface, comprising a shaped corner piece made in one piece of folded sheet material and comprising a first pair of wall sections for covering end parts of main frame side members perpendicular to one another and a second pair of wall sections for covering the parts of the roof surface which border on said main frame side members.

When flashing frame structures for roof windows to protect them from the weather it is common to use flashing covers of sheet metal, for instance aluminium, copper, steel or zinc. Conventionally, such flashing covers have been manufactured by ordinary tinman work from a plane sheet material which is profiled for the formation of two flanges for mounting against the outer side of a main frame member perpendicular to the roof surface and against the bordering part of the roof surface, respectively.

The comparatively costly adjustment and assembly work on location, which is required when using this conventional craftmanship, may be avoided by use of pre-manufactured flashing members which are normally carried out in such a way that four flashing members for covering the four sides of the frame structure are assembled by means of custom-made shaped corner pieces.

DK Patent No. 143.297 discloses a shaped corner piece with a pair of wall sections for flashing end parts of mutually perpendicular sides of the frame structure and a ledge portion running around the corner in question in form of sheet pieces bent from the planes of the wall sections. By folding the parts of the basic sheet material which do not form part of the wall sections or the ledge portion, this known shaped corner piece may be manufactured without cracks or incisions in the sheet material, which means a reduced risk of leakage, just as labour is saved due to the elimination of a part of the cutting and welding work which has been used in the conventional manual production.

As this known shaped corner piece only covers end parts of the mutually perpendicular side members of the main frame structure itself, the flashing of the part of the roof surface positioned opposite the corner has, however, still to be carried out by means of adequately cut parts of the profile frame pieces, with which the shaped corner piece is connected, which means that a certain cutting and assembly work is still required on location with a subsequent risk of leakage, for instance as a consequence of badly made soldering.

DK-patent specification No. 98982 discloses a corner piece consisting of bitumen plate material. The bitumen plate is provided with one or more slits and is subsequently folded into shape for covering the corner of a roof penetrating structure, following which the corner piece is melted together with the surrounding roofing felt.

For use in connection with the same or other types of building structures other embodiments of prefabricated shaped corner pieces in form of flexible plastic film pieces are known from U.S. Pat. No. 4,700,512, or cast, possibly flexible plastic components, U.S. Pat. No. 4,635,409 and DE published specification No. 36 03 303.

U.S. Pat. No. 3,247,632 discloses a flashing for roof windows, said flashing comprising a collar with wall sections for covering the end parts of the mutually perpendicular sides of the main frame structure and of the parts of the roof surface adjacent to these sides. Thus, no care has been taken according to this publication in respect of covering the part of the roof surface opposite the very corner.

On this background the object of the invention is to provide a flashing member comprising a shaped corner piece made by folding of a one-piece sheet billet, said corner piece not only comprising flashing wall sections for the mutually perpendicular sides of the main frame structure, but also wall components for covering the adjacent parts of the roof surface all the way around the corner in question.

In view of this a flashing member of the type stated is according to the invention characteristic in that said shaped corner piece also comprises a corner section for filling up the space between said second pair of wall sections, whereby both the first and the second pair of wall sections and said corner section are formed by folding from the same sheet billet, the parts of the sheet material not being part of said wall sections and said corner section being folded for providing partly two double-walled plane foldings which are parallel with the roof surface but perpendicular to each other, between said corner section and their respective sections of said second pair of wall sections, partly a double-walled triangular folding between the corner section and said first pair of wall sections.

Hereby, a completely water and wind proof corner flashing is provided, said flashing requiring no adaptation on location.

Advantageously, the spaced corner piece in connection with said first pair of wall sections may comprise flange pieces for abutting the top sides of the respective main frame side members.

A flashing member for covering for instance the main frame bottom member of a roof window may in itself be made thereby that two shaped corner pieces designed as above are connected with a side flashing member by means of conventional connections, for instance soldering.

In a preferred embodiment the flashing member according to the invention comprises, however, two shaped corner pieces and a side flashing member extending therebetween which are all made by folding from one and the same sheet billet, the side flashing member comprising two wall sections perpendicular to each other in connection with one of said first pair and said second pair of wall sections, respectively, in the respective shaped corner pieces.

Such generally U-shaped flashing members will typically be designed for flashing the bottom member and the top member of a main frame structure for a roof window, whereby the part of the flashing member for the main frame top member abutting the roof surface may form a valley.

A complete flashing frame, which in a simple way may be assembled on location without the need of soldering is obtained by comprising, with a view to being mounted along the main frame side members in parallel with the direction of the sloping of the roof, drain pieces with end portions which are doubled for providing an engagement flange for engaging the plane folding in a shaped corner piece perpendicular to the direction of the sloping of the roof.

The invention will now be explained in detail in the following with reference to the schematic drawing, in which FIG. 1 is a plane view of a starting sheet billet for use in the manufacture of a flashing member according to the invention, FIG. 2 is a sectional view illustrating the making of bending operations for producing a shaped corner piece by folding from a starting sheet billet as shown in FIG. 1, FIG. 3 shows a cart of a finished flashing member or mounting on a main frame bottom member of a roof window, and FIG. 4 is a perspective view of a side drain piece for connection with a flashing member as shown in FIG. 3.

FIG. 1 shows in the right hand side a section of an embodiment of a starting sheet billet for a shaped corner piece for a flashing member according to the invention and comprises a first pair of wall sections 1 and 2 to be placed against end parts of the mutually perpendicular side members in a main frame structure for a roof window, a second pair of wall sections 3 and 4 intended for covering the parts of the roof surface bordering such main frame side members and a corner piece 5 for filling out between the second pair of wall sections 3 and 4.

The embodiment shown moreover comprises, in connection with the first pair of wall sections 1 and 2, flange pieces 6 and 7 to be positioned in abutment with the top sides of the main frame members. The flange pieces 6 and 7 are at the top point 8 of the geometrical corner separated from each other by cutting along a 90° bent cutting line 9, 10.

The shaped corner piece is made from the starting material shown by bending along a number of bending lines which appears most clearly from the sectional view in FIG. 2. The solid bending lines 11–16 indicate bending operations, in which the sheet material at one side of the bending line is bent in a direction inwards in the plane of the drawing relative to the sheet material at the other side of the bending line. Dashed bending lines 17–23 indicate on the other hand bending operations, in which the sheet material at one side of the bending line is bent in a direction outwards of the plane of the drawing relative to the sheet material at the other side of the bending line.

The solid bending lines 11, 12 indicate thus 90 ° bendings between the flange pieces 6, 7 and the first pair of wall sections 1 and 2, respectively, and the dashed bending lines 17, 18 indicate 90° bendings between one of the first pair of wall sections 1, 2 and one of the second pair of wall sections 3, 4.

The solid bending lines 13, 14 and the dashed bending lines 19, 20 indicate 180° bendings, by means of which parts 24 and 25 of the sheet material, which in the finished shaped corner piece are not to form part of the wall sections 1–4 or the corner section 5, are shaped into two double-walled, mutually perpendicular plane foldings in parallel with the roof surface between the corner section 5 and each theirs of the second pair of wall sections 3, 4 as shown in FIG. 3.

The solid bending lines 15, 16 and the dashed bending lines 21–23 indicate similarly 180° bending operations, by means of which other parts 28–30 of the sheet material, which in the finished shaped corner piece are not to form part of the wall sections 1–4 or the corner section 5, are formed into a double-walled triangular folding 31 between the corner section and each of the first wall sections 1, 2.

With a view to obtaining an improved adaptation to a sharp corner edge between the outer sides of the main frame side members, the triangular folding 31 may be bent 90° along a bending line 32 which in FIG. 1 is shown with a dash-dot line. This is, however, not absolutely imperative.

The shaped corner piece shown in the right hand side of FIG. 1 may in itself be connected with side flashing members in a conventional manner, for instance through soldering, but forms preferably part of a substantially U-shaped flashing frame for mounting on the bottom member or the top member of a main frame structure for a roof window. Such a flashing member comprises as shown in the left hand side of FIG. 1 a further shaped corner piece 33 and a side flashing member 34 extending between the two shaped corner pieces and may according to the invention in its entity be made from a single continuous sheet billet.

Figure 1:
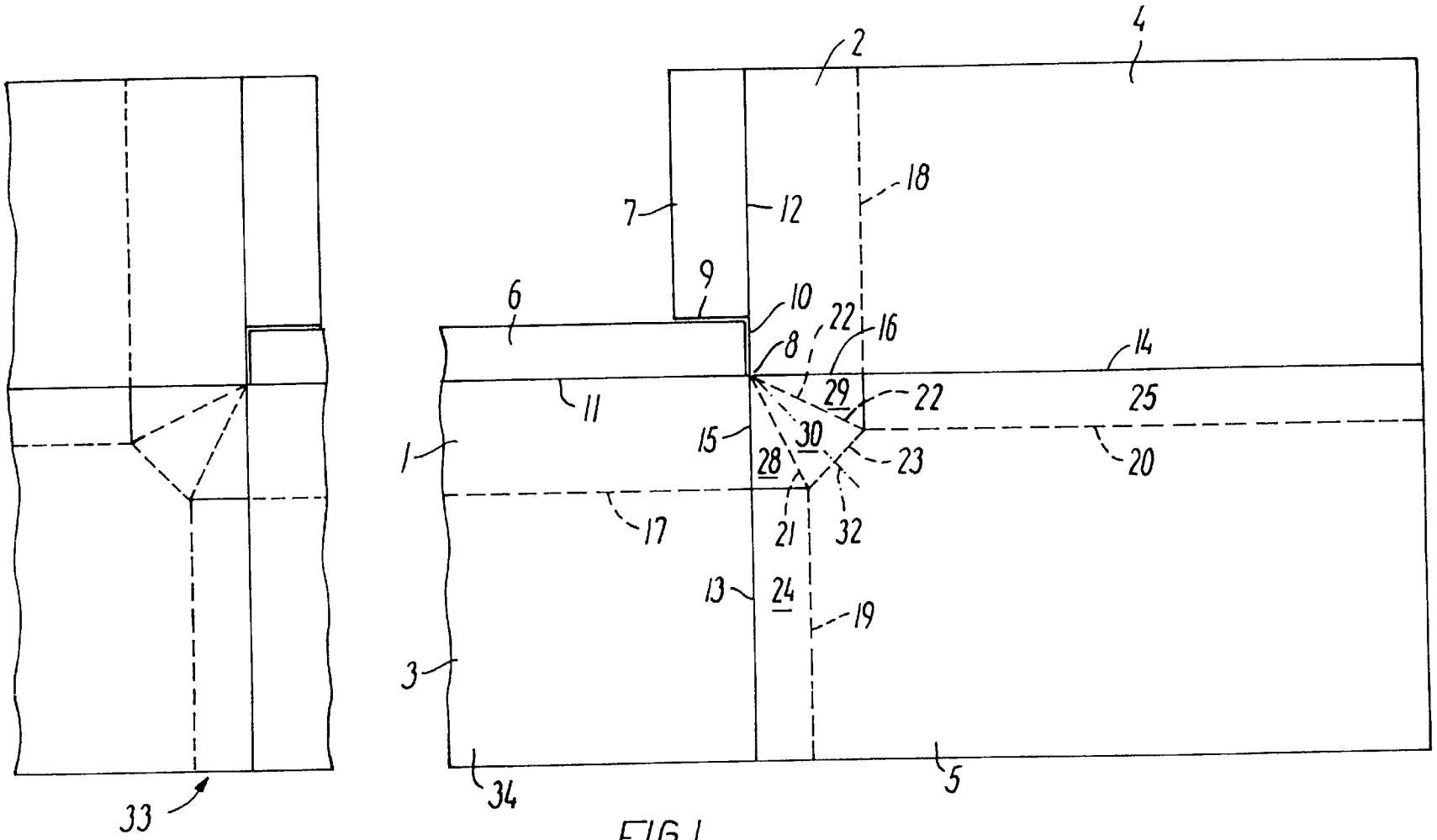
Figure 2:
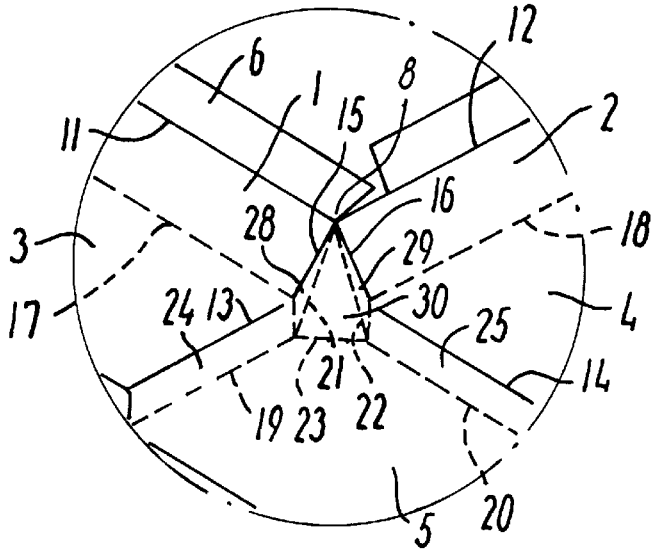
FIG. 2 is a sectional view of parts of the shaped corner piece during an intermediate stage of the manufacturing process for a closer illustration of the bending operations.
Figure 3:
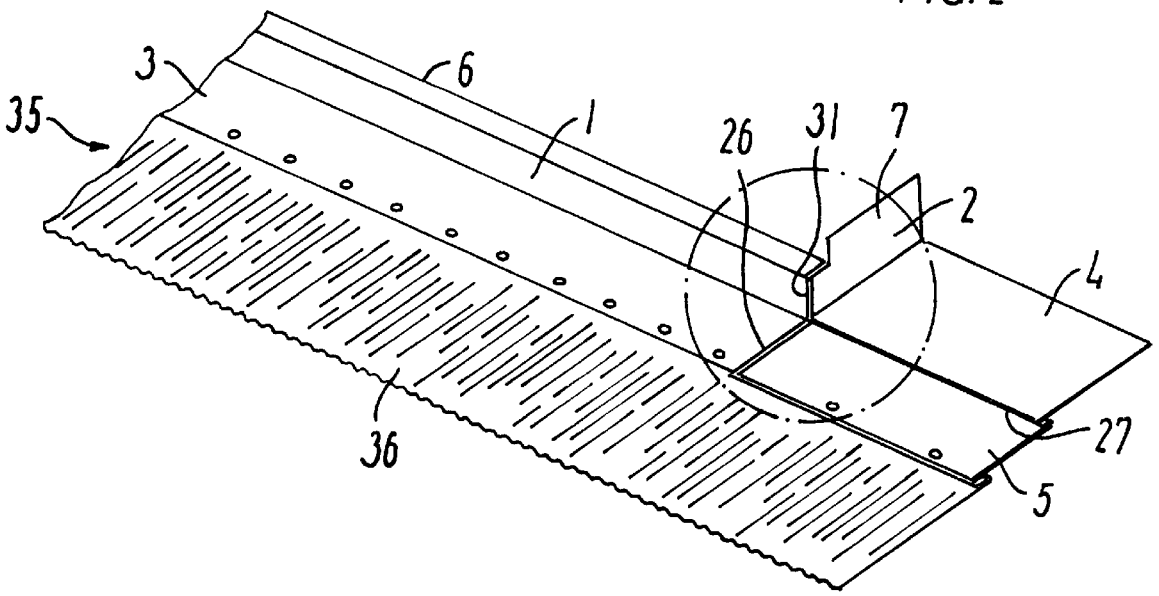
FIG. 3 shows a part of a finished bottom flashing member 35 designed as explained above in connection with a subjacent skirt 36 of a manually deformable flashing material.
Figure 4:
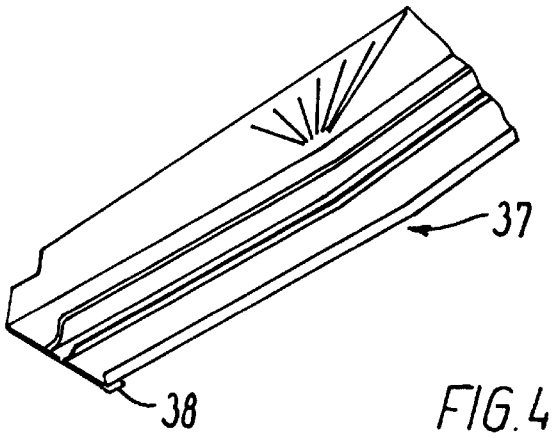

By flashing members as shown in FIG. 3 mounted on the bottom member and the top member of a main frame structure for a roof window a complete flashing is obtained by mounting drain pieces 37 along the main frame side members as shown in FIG. 4. The particular design of the shaped corner pieces thus makes a most simple assembly possible by bending end portions of such drain pieces as shown at 38 for the formation of engagement flanges for engagement with the plane folding 27 of a shaped corner piece perpendicular to the direction of the roof pitch.

Flashing frames manufactured in accordance with the invention may also be used in other types of roof penetrating building structures, for instance chimneys, by adapting the bendings between the wall sections at the sides of the building structure which do not form a right angle with the roof surface.

I claim:

1. A sheet metal flashing member for frame structures of roof windows or similar roof penetrating building structures with main frame side surfaces substantially perpendicular to the surrounding parts of the roof surface, comprising a shaped corner piece made in one piece of folded sheet material and comprising a first pair of wall sections (1, 2) for covering end parts of main frame side members perpendicular to one another and a second pair of wall sections (3, 4) for covering the parts of the roof surface which border on said main frame side members, characterized in that said shaped corner piece also comprises a corner section (5) for filling up the space between said second pair of wall sections (3, 4), whereby both the first and the second pair of wall sections and said corner section (1–5) are formed by folding from said one piece of sheet material, the parts (24, 25, 28–30) of the sheet material not being part of said wall sections and said corner section being folded for providing partly two double-walled plane foldings (26, 27), which are adapted to be parallel with the roof surface but perpendicular to each other, between said corner section (5) and their respective sections of said second pair of wall sections (3, 4), and partly a double-walled triangular folding (31) between the corner section (5) and said first pair of wall sections (1, 2).

2. A flashing member according to claim 1, characterized in that said first pair of wall sections (1, 2) comprises flange pieces (6, 7) for abutting the top sides of the respective main frame side members.

3. A flashing member according to claim 1, characterized in comprising two said shaped corner pieces (33) and a side flashing member (34) extending therebetween which are all made by folding from the same said one piece of sheet material, the side flashing member comprising two wall sections perpendicular to each other in connection with one of said first pair and said second pair of wall sections, respectively, in the respective shaped corner pieces.

4. A flashing frame comprising a flashing member according to claim 1, characterized in comprising, for mounting along the main frame side members in parallel with the direction of the sloping of the roof, drain pieces (37) with end portions (38) which are doubled for providing an engagement flange for engaging the plane folding of said shaped corner piece perpendicular to the direction of the sloping of the roof.

* * * * *